US010378238B2

(12) United States Patent
Beck et al.

(10) Patent No.: US 10,378,238 B2
(45) Date of Patent: Aug. 13, 2019

(54) INTERCONNECTED LOCKING SYSTEM

(71) Applicant: Spectrum Brands, Inc., Middleton, WI (US)

(72) Inventors: Chasen Scott Beck, Cypress, CA (US); Nedal Akram Almomani, Mission Viejo, CA (US); Phil Szuba, Trabuco Canyon, CA (US)

(73) Assignee: Spectrum Brands, Inc., Middleton, WI (US)

( * ) Notice: Subject to any disclaimer, the term of this patent is extended or adjusted under 35 U.S.C. 154(b) by 293 days.

(21) Appl. No.: 14/189,460

(22) Filed: Feb. 25, 2014

(65) Prior Publication Data

US 2014/0260448 A1 Sep. 18, 2014

Related U.S. Application Data

(60) Provisional application No. 61/780,511, filed on Mar. 13, 2013.

(51) Int. Cl.
*E05B 53/00* (2006.01)
*E05B 47/00* (2006.01)
(Continued)

(52) U.S. Cl.
CPC ..... *E05B 47/00* (2013.01); *E05B 63/143* (2013.01); *E05B 65/0003* (2013.01);
(Continued)

(58) Field of Classification Search
CPC . Y10T 70/7062; Y10T 70/7068; Y10T 70/70; Y10T 70/625; Y10T 70/7107; Y10T 70/7102; Y10T 70/7113; E05B 47/0012; E05B 47/0001; E05B 47/00; E05B 47/026; E05B 47/06; E05B 47/068;
(Continued)

(56) References Cited

U.S. PATENT DOCUMENTS 3,803,575 A * 4/1974 Gotanda ..... 340/522
4,257,631 A * 3/1981 Logan, Jr. ..... 292/251.5
(Continued)

FOREIGN PATENT DOCUMENTS

AT 371538 B1 7/1983
DE 8629202 U 1/1987
(Continued)

OTHER PUBLICATIONS

International Searching Authority; International Search Report; dated Jun. 30, 2014.
(Continued)

*Primary Examiner* — Suzanne L Barrett
*Assistant Examiner* — Morgan J McClure
(74) *Attorney, Agent, or Firm* — Merhcant & Gould P.C.

(57) ABSTRACT

An interconnected locking system in which multiple locks may be interconnected to be locked and/or unlocked in a coordinated manner. In one embodiment, the locking system allows a user to lock or unlock a door with multiple locking points with a single activation of one of the locks, such as when a deadbolt or lever is activated. The multiple locking points communicate together wirelessly, for example, to activate all the locking points as desired or set by the user.

23 Claims, 6 Drawing Sheets

(51) Int. Cl.

| | |
|---|---|
| ***E05B 63/14*** | (2006.01) |
| ***E05B 65/00*** | (2006.01) |
| *E05B 47/02* | (2006.01) |
| *E05B 63/00* | (2006.01) |
| *E05B 65/10* | (2006.01) |
| *E05C 7/04* | (2006.01) |
| *G07C 9/00* | (2006.01) |

(52) U.S. Cl.
CPC ..... *E05B 47/0001* (2013.01); *E05B 47/0012* (2013.01); *E05B 47/026* (2013.01); *E05B 63/0065* (2013.01); *E05B 65/1006* (2013.01); *E05B 2047/0094* (2013.01); *E05C 7/04* (2013.01); *G07C 9/00571* (2013.01); *Y10T 70/625* (2015.04)

(58) Field of Classification Search
CPC .. E05B 65/0003; E05B 65/1006; E05B 65/36; E05B 63/143; E05B 63/0065; E05B 2047/0071; E05B 2047/0094; G07C 9/00111; G07C 9/00007; G07C 9/00309; G07C 9/00071; G07C 9/00174; G08C 17/02; G08C 17/04; G08C 17/06; E05C 7/04
USPC ..... 70/263–266, 277, 278.1; 340/5.2–5.7
See application file for complete search history.

(56) References Cited

U.S. PATENT DOCUMENTS

| | | | | |
|---|---|---|---|---|
| 4,762,350 | A * | 8/1988 | Hurtado | 292/259 R |
| 4,848,114 | A * | 7/1989 | Rippe | 70/263 |
| 5,386,713 | A * | 2/1995 | Wilson | 70/280 |
| 5,429,399 | A * | 7/1995 | Geringer et al. | 292/92 |
| 5,541,585 | A * | 7/1996 | Duhame et al. | 340/5.62 |
| 5,823,027 | A * | 10/1998 | Glick et al. | 70/278.2 |
| 5,936,544 | A * | 8/1999 | Gonzales et al. | 340/5.22 |
| 5,941,106 | A * | 8/1999 | Williamson et al. | 70/278.1 |
| 6,047,998 | A * | 4/2000 | Pollard et al. | 292/1 |
| 6,486,793 | B1 * | 11/2002 | Buccola | 340/5.2 |
| 6,786,005 | B1 * | 9/2004 | Williams | 49/141 |
| 7,170,998 | B2 * | 1/2007 | McLintock et al. | 380/277 |
| 7,339,473 | B2 * | 3/2008 | Lucas | B60R 25/08 340/5.7 |
| 7,347,461 | B2 * | 3/2008 | Sprague | 292/336.3 |
| 7,689,293 | B2 * | 3/2010 | Weik, III | A62C 2/24 340/5.28 |
| 7,701,331 | B2 * | 4/2010 | Tran | 340/539.1 |
| 8,085,128 | B2 * | 12/2011 | Colley, III | 340/5.7 |
| 8,231,151 | B2 * | 7/2012 | Barrieau | 292/251.5 |
| 8,284,018 | B2 * | 10/2012 | Ibsies | 340/3.1 |
| 8,604,903 | B2 * | 12/2013 | Bowen et al. | 340/5.6 |
| 2006/0101721 | A1 | 5/2006 | Weik, III et al. | |
| 2006/0164208 | A1 * | 7/2006 | Schaffzin et al. | 340/5.64 |
| 2007/0044524 | A1 | 3/2007 | Coutermarsh et al. | |
| 2009/0302995 | A1 | 12/2009 | Park | |
| 2010/0066487 | A1 * | 3/2010 | Bell | B60R 25/00 340/5.6 |
| 2010/0281933 | A1 | 11/2010 | Barrieau | |

FOREIGN PATENT DOCUMENTS

| | | | | |
|---|---|---|---|---|
| DE | 19708251 | A1 | 3/1998 | |
| DE | 102011053348 | A1 | 3/2013 | |
| EP | 0231532 | A1 | 8/1987 | |
| EP | 0248488 | A2 | 12/1987 | |
| EP | 0505887 | | 3/1992 | |
| EP | 0546701 | A | 6/1993 | |
| EP | 0722156 | A | 7/1996 | |
| EP | 1055793 | A | 11/2000 | |
| EP | 2083140 | A2 | 7/2009 | |
| EP | 2423414 | A1 | 2/2012 | |
| FR | 2520041 | A | 7/1983 | |
| FR | 2594467 | | 2/1986 | |
| FR | 2709018 | A | 2/1995 | |
| FR | 2740165 | A1 * | 4/1997 | E05B 47/02 |
| FR | 2740165 | A1 | 4/1997 | |
| FR | 2741103 | | 5/1997 | |
| FR | 2823248 | A1 | 10/2002 | |
| FR | 2883901 | A1 | 10/2006 | |
| GB | 352481 | | 7/1931 | |
| GB | 2230550 | A | 10/1990 | |
| GB | 2352000 | A | 7/2001 | |
| GB | 2380224 | A | 4/2003 | |
| JP | 2000334147 | A | 12/2000 | |
| JP | 2001-329728 | | 11/2001 | |
| JP | 2008-031778 | | 2/2008 | |
| JP | 2008-190224 | | 8/2008 | |
| WO | WO8904905 | | 6/1989 | |
| WO | WO9005822 | | 5/1990 | |

OTHER PUBLICATIONS

International App. No. PCT/US2014/018393, International Preliminary Report on Patentability dated Sep. 24, 2015.
Notice of Opposition to European Application No. 14709145.8, dated May 7, 2019 (47 pgs).

* cited by examiner

INTERCONNECTED LOCKING SYSTEM

RELATED APPLICATIONS

This application claims the benefit of U.S. Provisional Application Ser. No. 61/780,511 filed Mar. 13, 2013, for an "Interconnected Locking System," which is hereby incorporated by reference in its entirety.

TECHNICAL FIELD

This disclosure relates generally to locks; in particular, this disclosure relates to a system in which multiple locks may be interconnected to be locked and/or unlocked in a coordinated manner.

BACKGROUND

Many types of locks are available, such as deadbolts, knob locks, lever handle locks, mortise locks and slide locks. These locks can be used to secure doors and gates to prevent entry into a secured area. Although a single lock may suffice to secure some entries, there are circumstances when multiple locks are needed. However, multiple locking points create complexity.

If a user wants to have multiple points of locking on a door, multiple manual operations must be performed. For example, consider a customer with a deadbolt, lever, and a slide bolt on the front door. The customer must unlock the deadbolt, lever, and slide the bolt manually one at a time. The problem becomes even more complex in a double door scenario and as the number of locking points increase. Therefore, there exists a need for a new locking system that reduces this complexity.

SUMMARY

According to one aspect, this disclosure relates to a locking system in which multiple locks may be interconnected to be locked and/or unlocked in a coordinated manner. For example, the locking system allows a user to lock or unlock a door with multiple locking points with a single activation of one of the locks, such as when a deadbolt or lever is activated. The multiple locking points communicate together wirelessly, for example, to activate all the locking points as desired or set by the user. There is no need to manually turn, unlock, or slide each individual locking point, some of which may be high and out of reach, which would be particularly useful for the young or infirm. This is convenient for the user and saves time, frustration, and provides the user additional security without the hassle of manual locks. This above scenario is an example of a typical door; however, this disclosure is a multi-locking solution that could be implemented on any door or more generically a portal such as a doorway, entrance, gate, or aperture.

In one embodiment, the interconnecting locking system includes a plurality of locking points each movable between a locked position and an unlocked position. The locking points have a wireless communication feature configured to allow wireless communication between the plurality of locking points. Typically, the plurality of locking points are arranged in an approximately coplanar manner. The movement of the plurality of locking points between the locked position and the unlocked position is wirelessly coordinated responsive to actuation of at least one of the plurality of locking points between the locked position and the unlocked position. In some cases, at least a portion of the locking points move between the locked position and the unlocked position responsive to wireless communications received from another locking point. Depending on the circumstances, at least one of the locking points is a deadbolt and a portion of the plurality of locking points move between the locked position and the unlocked position responsive to wireless communications indicative of the deadbolt moving between the locked position and the unlocked position. For example, a knob could be configured to move between the locked position and the unlocked position responsive to wireless communications indicative of the deadbolt moving between the locked position and the unlocked position. Likewise, a plurality of mortised bolt mechanisms could be configured to move between the locked position and the unlocked position responsive to wireless communications indicative of the deadbolt moving between the locked position and the unlocked position. Embodiments are contemplated in which the system includes a first locking mechanism and a second locking mechanism, both associated with a first door. The first locking mechanism and the second locking mechanism are communicatively coupled to one another. Locking or unlocking actuation of the first locking mechanism triggers communication with the second locking mechanism to actuate locking or unlocking of the second locking mechanism.

In some cases, the system includes a third locking mechanism associated with the first door. The third locking mechanism may be communicatively coupled to the first and second locking mechanisms. Actuation of the first locking mechanism triggers locking or unlocking actuation of only the second locking mechanism.

In some cases, the system may include a third locking mechanism associated with a second door. The third locking mechanism is communicatively coupled to the first and second locking mechanisms. Locking or unlocking actuation of the first locking mechanism triggers locking or unlocking of both the second and third locking mechanisms.

According to another aspect, the disclosure provides an interconnected electronic lockset comprising a first lock mounted on the first door, and a second lock mounted on the first door. The first lock may be communicably coupled to the second lock. Locking or unlocking actuation of the first lock triggers wireless communication with the second lock to actuate locking or unlocking of the second lock.

In some cases, the lockset includes a third lock mounted externally to a frame of a second door. The third lock may be communicatively coupled to the first and second locks. The locking or unlocking actuation of the first lock triggers locking or unlocking of both the second and the third locks.

In some cases, the lockset includes a third lock mounted externally to a frame of the first door. The third lock may be communicatively coupled to the first and second locks. The locking or unlocking actuation of the first lock triggers locking or unlocking actuation of the second lock, but not the third lock.

Additional features and advantages of the invention will become apparent to those skilled in the art upon consideration of the following detailed description of the illustrated embodiment exemplifying the best mode of carrying out the invention as presently perceived. It is intended that all such additional features and advantages be included within this description and be within the scope of the invention.

BRIEF DESCRIPTION OF THE DRAWINGS

The present disclosure will be described hereafter with reference to the attached drawings which are given as non-limiting examples only, in which.

Figure 1:
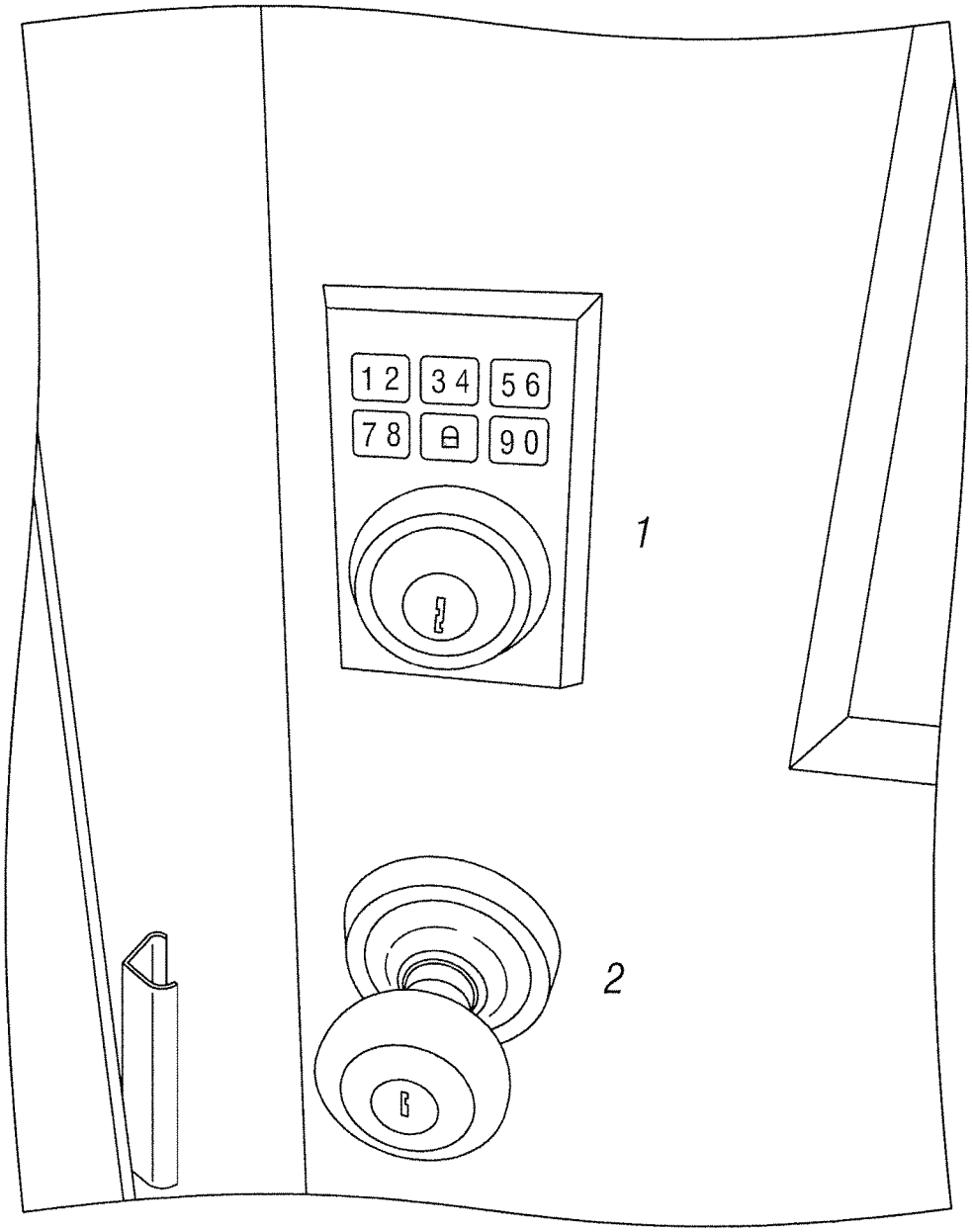
FIG. 1 is a diagrammatic representation of an example interconnected locking system with a deadbolt and knob according to an embodiment of the disclosure.

Corresponding reference characters indicate corresponding parts throughout the several views. The components in the figures are not necessarily to scale, emphasis instead being placed upon illustrating the principals of the invention. The exemplification set out herein illustrates embodiments of the invention, and such exemplification is not to be construed as limiting the scope of the invention in any manner.

DETAILED DESCRIPTION OF THE DRAWINGS

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the disclosure.

This disclosure generally relates to a locking system in which multiple locks or locking points may be interconnected to be locked and/or unlocked in a coordinated manner. The term "lock" or "lockset" is broadly intended to include any type of lock, including but not limited to deadbolts, knob locks, lever handle locks, mortise locks and slide locks, whether mechanical, electrical or electro-mechanical locks. The locking points may have various mounting configurations and/or locations, including but not limited to: mortised within the door frame, mounted externally to the door frame or support structure, and/or affixed directly to the door.

The interconnected system may have an unlimited number of locking points. In one embodiment, for example, a first lock may wirelessly communicate with a plurality of interconnected locks so that actuation of the first lock also actuates one or more of the other interconnected locks. For example, the plurality of interconnected locks may have a wireless communication feature that allows communication between locks. By way of example only, the wireless communication capability of the locks could use the IEEE 802.11 standard, such as using Wi-Fi, or the IEEE 802.15.4 standard, such as using Zigbee, the IEEE 802.15.1 standard, such as Bluetooth, a cellular network, a wireless local area network, or other network protocols. Accordingly, the locks could communicate directly with each other, or use a wireless gateway, and/or coordinate with other networking devices.

In some embodiments, the interconnected locks could be configured with different modes. In a limited operation, for example, only one locking point is locked/unlocked upon activation. The selection of the locking point can be configured by the user. In another mode, which could be the normal operation mode that is primarily used for day-to-day operations, not all locking points lock/unlock after activation. The number and selection of the locking points can be configured by the user. In an extended operation, all locking points could be locked/unlocked upon single activation. By way of another example, in an emergency operation, all locks and mechanisms enter into their unlock positions upon activation.

The following are examples of certain locking point configurations, but this disclosure should not be limited to these particular locking point configurations. FIG. 1 shows an example residential door with an electronic deadbolt (1) and knob (2) mounted externally on the primary entrance. In this example, the locking system could be configured such that all locks and mechanisms enter into their respective lock/unlock positions as the deadbolt is locked/unlocked.

Figure 2:
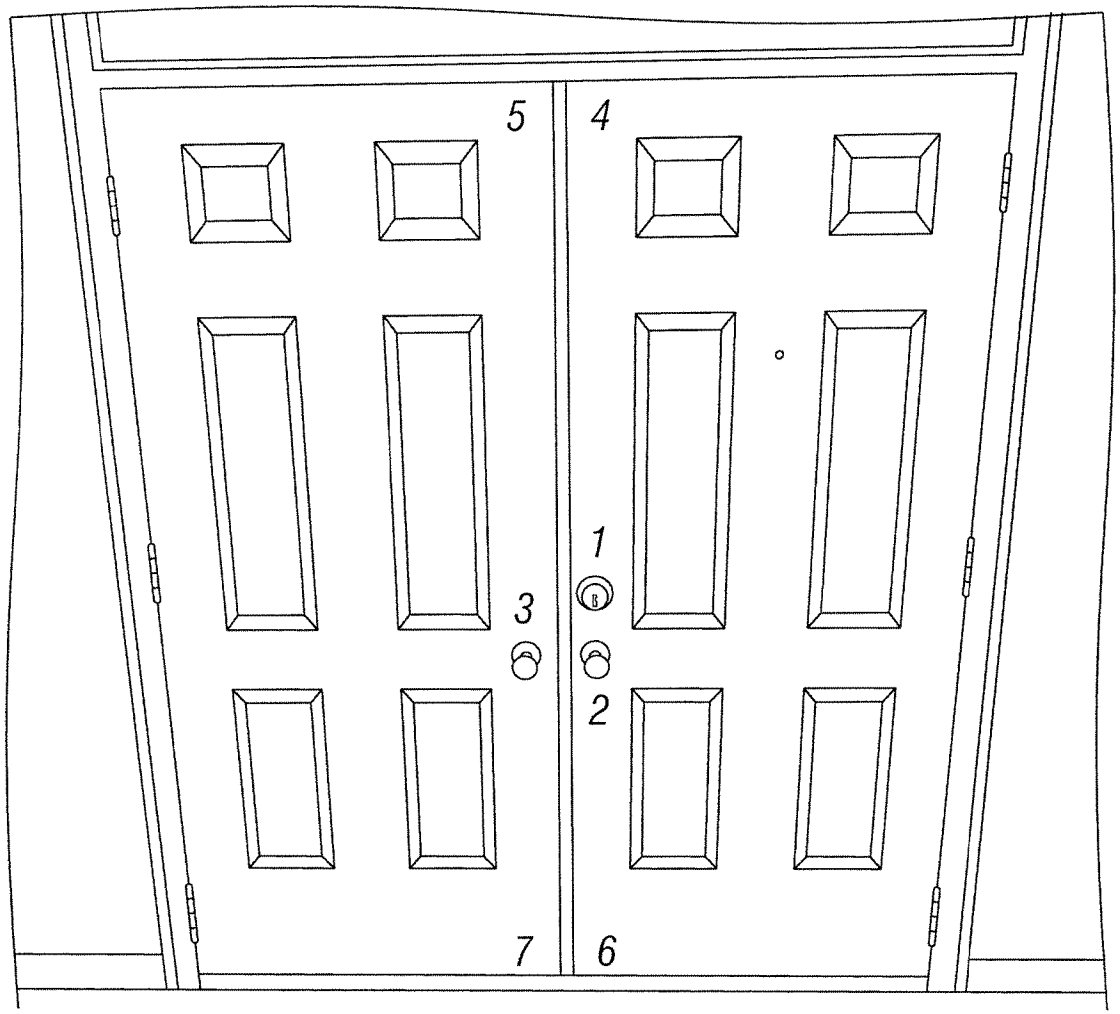
FIG. 2 is a diagrammatic representation of an example interconnected locking system with a deadbolt and mortised bolt mechanisms according to an embodiment of the disclosure.

FIG. 2 shows an example residential double door that has a deadbolt (1) and knob (2) mounted externally on the primary entrance. The secondary entrance has a knob mounted externally (3). Both entrances have mortised bolt mechanisms located in the door (5) (6) (7) (8). The locking system could be configured such that all locks and mechanisms enter into their respective lock/unlock positions as the deadbolt is locked/unlocked.

Figure 3:
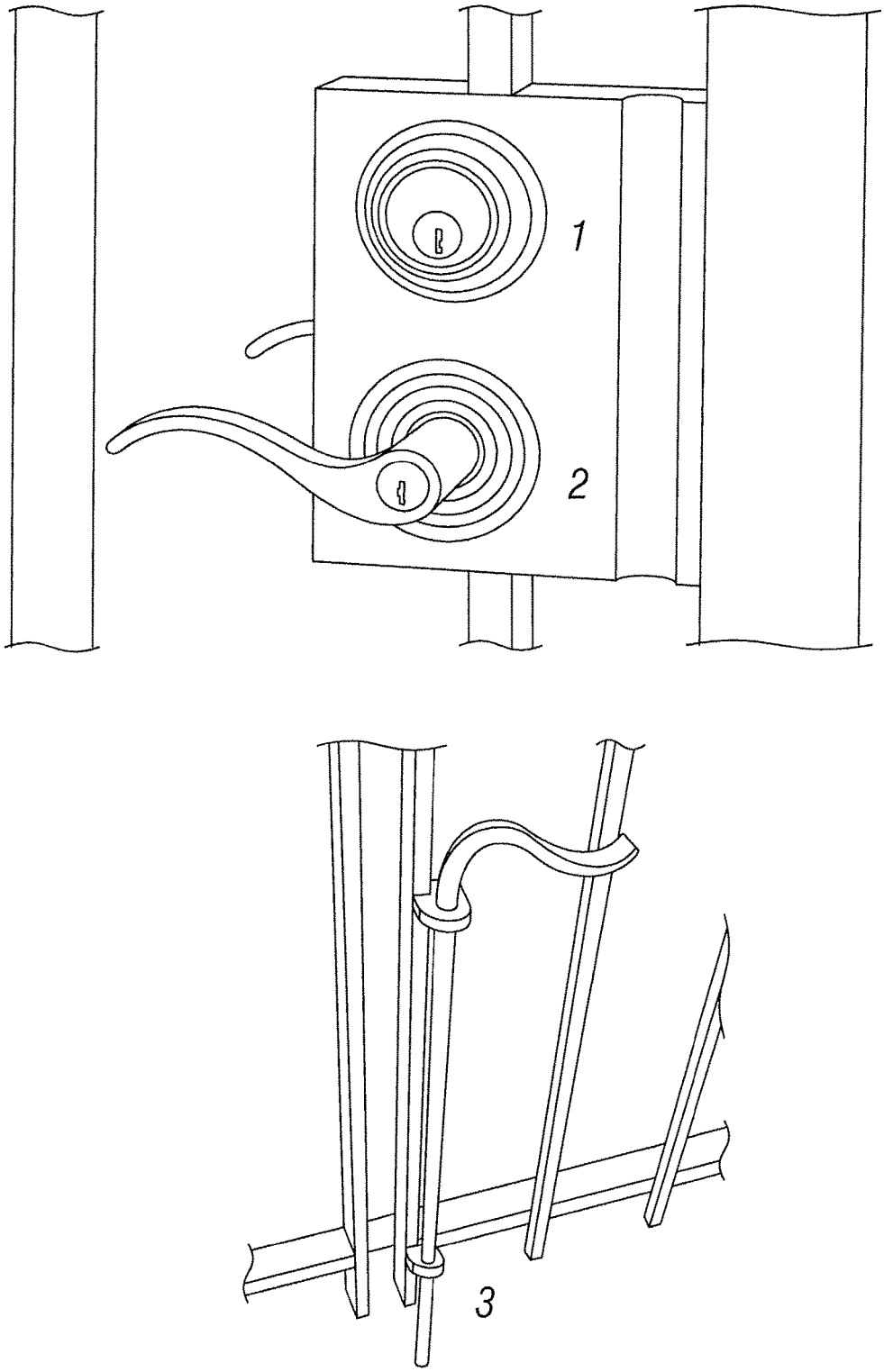
FIG. 3 is a diagrammatic representation of an example interconnected locking system with a deadbolt, lever, and cane bolt according to an embodiment of the disclosure.

FIG. 3 shows an example gate with a deadbolt (1), lever (2), and cane bolt (3). The locking system could be configured such that all locks and mechanisms enter into their respective unlock position as the deadbolt is unlocked.

Figure 4:
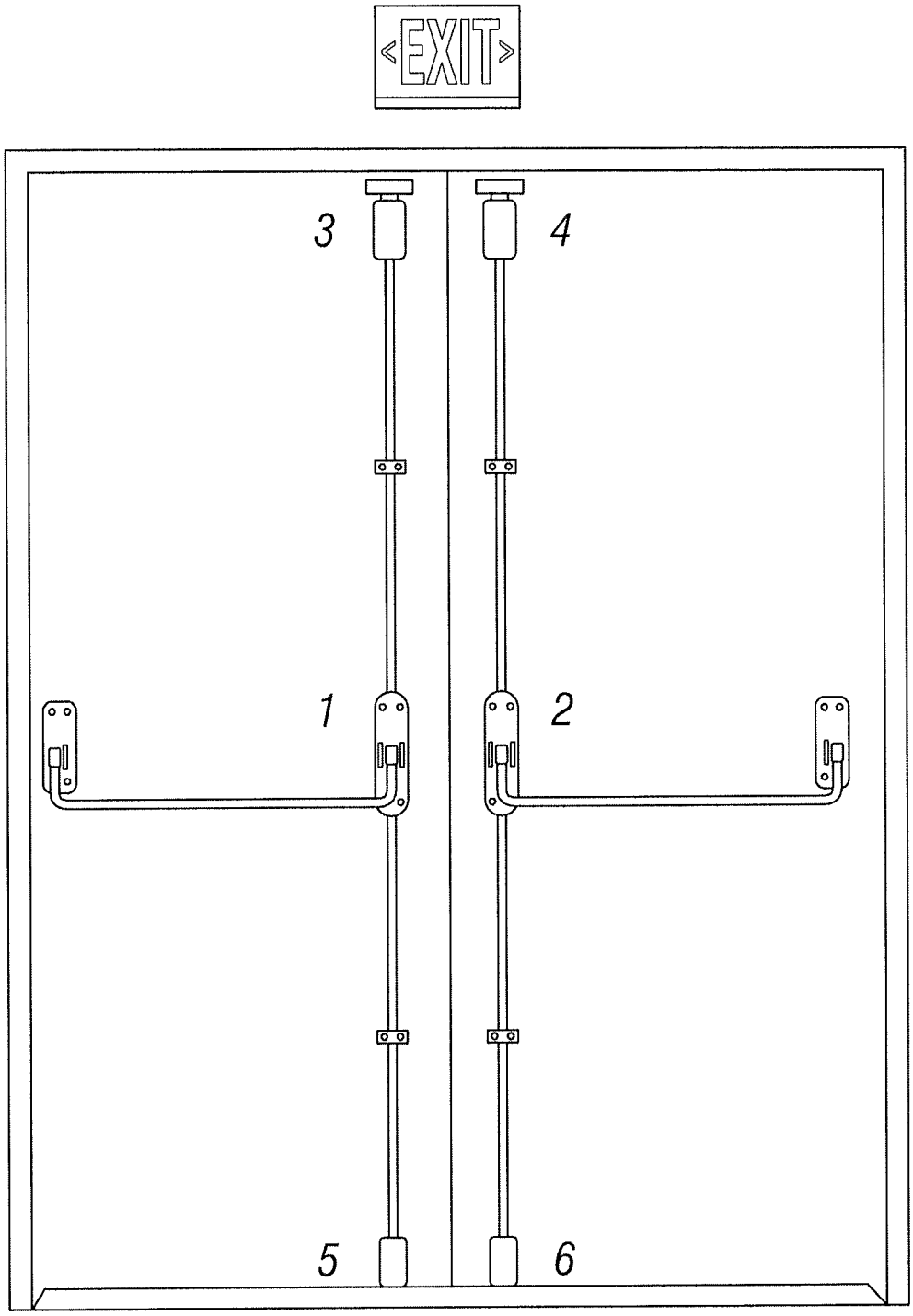
FIG. 4 is a diagrammatic representation of an example interconnected locking system with a double door that has panic bars and in which each door has bolt release mechanisms according to an embodiment of the disclosure.

FIG. 4 shows an example commercial double door that has panic bars on both doors (1)(2). Each door in this example has bolt release mechanisms at the top (3)(4) and bottom (5)(6). The locking system could be configured such that all locks and mechanisms enter into their respective lock/unlock positions as one of these locks is locked/unlocked.

Figure 5:
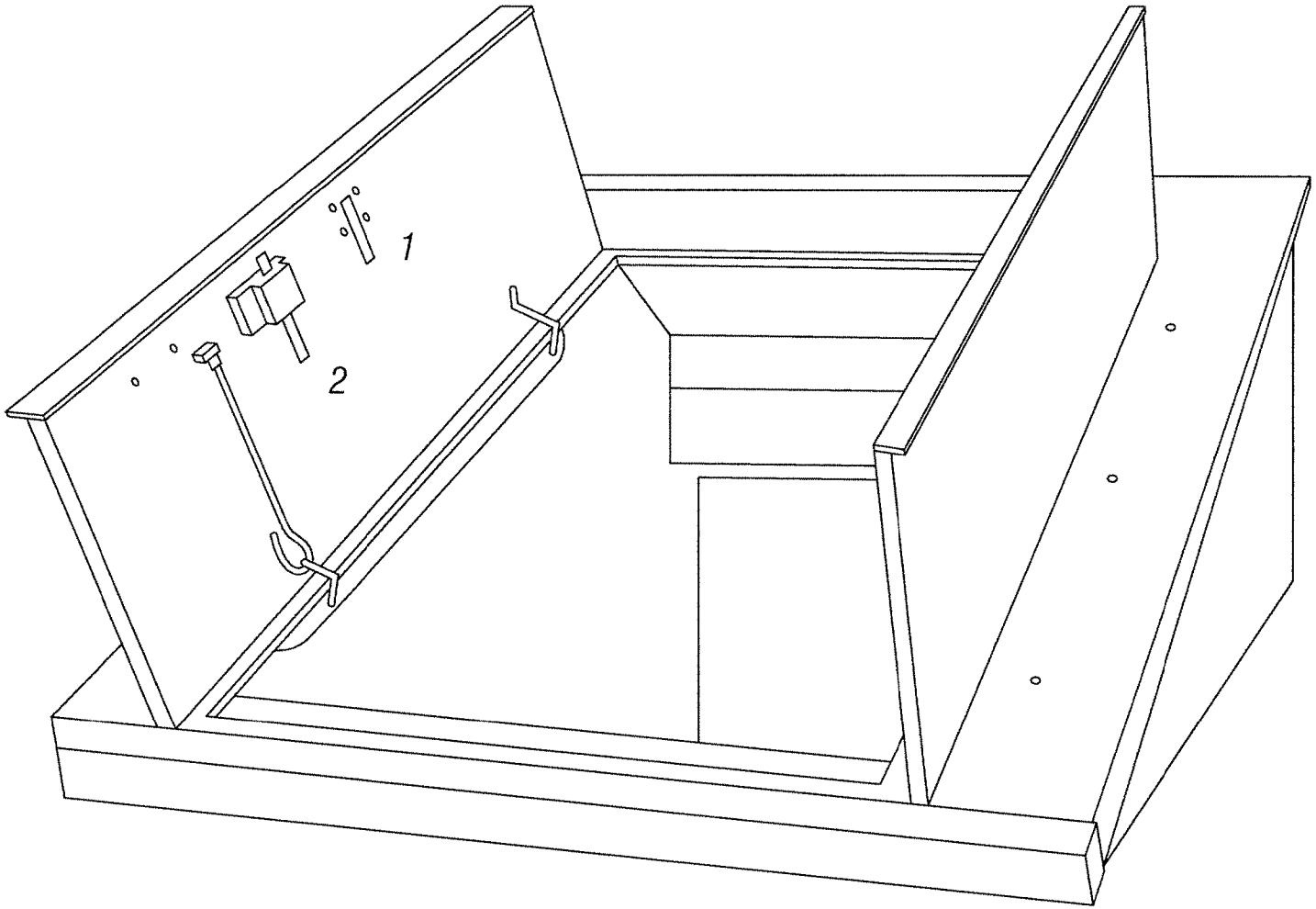
FIG. 5 is a diagrammatic representation of an example interconnected locking system with a slide bolt and a locking bolt according to an embodiment of the disclosure.

FIG. 5 shows an example basement door that has two bolts: a slide bolt (1) and a locking bolt (2). The locking system could be configured such that all locks and mechanisms enter into their respective lock/unlock positions as one of the locks is locked/unlocked.

Figure 6:
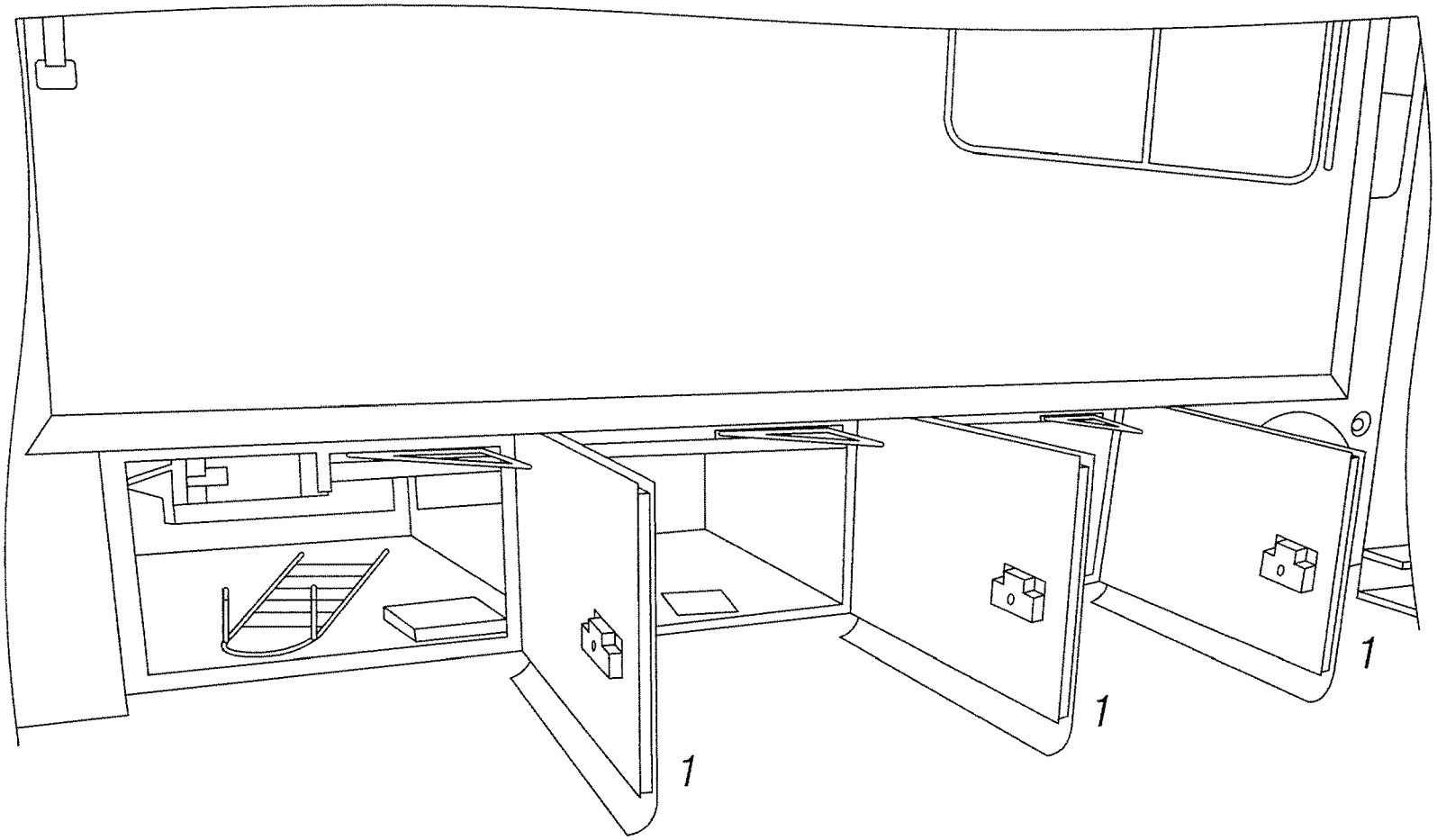
FIG. 6 is a diagrammatic representation of an example interconnected locking system with RV storage doors.

FIG. 6 shows an example set of RV storage doors. This example has three doors with a paddle lock on each door (1). The locking system could be configured such that all locks enter into their respective locked/unlock position if any of the paddle locks are locked/unlocked.

The activation or authentication between the locking points could be done in a variety of manners, including but not limited to: biometric, combination (electronic), mechanical ("key"), encryption (mathematical or otherwise) and/or defined electronic signals or packets. This disclosure should not be limited by the particular manner by which the locks are authenticated.

This disclosure is not limited to wireless links between the locks. Embodiments are also contemplated in which the interconnection could be capacitively coupled (e.g., when someone touches the handle set or knob to open a door, some of the set locking points engages or disengages), mechanically linked, or electronically wired together.

Although the present disclosure has been described with reference to particular means, materials, and embodiments, from the foregoing description, one skilled in the art can easily ascertain the essential characteristics of the invention and various changes and modifications may be made to adapt the various uses and characteristics without departing from the spirit and scope of the invention.

What is claimed is:

1. An interconnected locking system comprising:

a plurality of locking points positioned around a single secure area opening, each locking point movable between a locked position and an unlocked position, wherein when in the locked position, the plurality of locking points lock the single secure area opening, wherein at least two locking points of the plurality of locking points have a wireless communication feature configured to allow wireless communication between the at least two locking points, wherein the plurality of locking points are arranged in an approximately coplanar manner;

wherein the at least two locking points are further configured to:

transmit wireless signals such that (i) a first locking point is configured to transmit a first wireless signal to actuate a second locking point, wherein the second locking point is configured to actuate between a locked and an unlocked position in response to the first wireless signal; and (ii) the second locking point is configured to transmit a second wireless signal to actuate the first locking point, wherein the first locking point is configured to actuate between a locked and an unlocked position in response to the second wireless signal, wherein wireless coordination of movement between the unlocked position and the locked position is user-selectable as to how many of the plurality of locking points wirelessly coordinate movement;

wherein at least a portion of the plurality of locking points move between the locked position and the unlocked position responsive to receiving the wireless signal; and wherein the at least two locking points have first and second modes that are configured by a user, wherein, in a first mode, less than all of the at least two locking points are locked or unlocked and, in a second mode, all of the at least two locking points are locked or unlocked, wherein, when either the first or second locking point is actuated by the user and based on if the actuated first or second locking point is in the first mode or the second mode, the actuated first or second locking point transmits the associated first or second signal to trigger the actuation of the other corresponding first and second locking point.

2. The system of claim 1, wherein at least one of the locking points is a deadbolt and wherein at least a portion of the plurality of locking points move between the locked position and the unlocked position responsive to wireless communications indicative of the deadbolt moving between the locked position and the unlocked position.

3. The system of claim 2, wherein at least one of the locking points is a knob that is configured to move between the locked position and the unlocked position responsive to wireless communications indicative of the deadbolt moving between the locked position and the unlocked position.

4. The system of claim 3, wherein at least one of the locking points includes a plurality of mortised bolt mechanisms configured to move between the locked position and the unlocked position responsive to wireless communications indicative of the deadbolt moving between the locked position and the unlocked position.

5. The system of claim 1, wherein at least a portion of the plurality of locking points enter into the unlocked position responsive to wireless communications indicative of an emergency.

6. The system of claim 1, wherein at least a portion of the plurality of locking points are of a different type of lock from each other.

7. An interconnected lockset comprising:

a first lock movable between a locked position and an unlocked position, wherein the first lock includes a wireless communication feature;

a second lock movable between a locked position and an unlocked position, wherein the second lock is configured to wirelessly communicate with the first lock, wherein the second lock is installed approximately coplanar with the first lock and the second lock and first lock are installed around a single secure area opening, wherein when in the locked positions, the first and second locks lock the single secure area opening; and a third lock installed approximately coplanar with respect to the first lock, wherein the third lock is configured to wirelessly communicate with the first lock;

wherein each of the first, second, and third locks is configured to:

transmit wireless signals such that (i) the first lock is configured to transmit a first wireless signal to actuate the second lock, wherein the second lock is configured to actuate between a locked and an unlocked position in response to the first wireless signal; (ii) the second lock is configured to transmit a second wireless signal to actuate the first lock, wherein the first lock is configured to actuate between a locked and an unlocked position in response to the second wireless signal; and (iii) the third lock is configured to transmit a third wireless signal to actuate the first lock, wherein the first lock is configured to actuate between a locked and an unlocked position in response to the third wireless signal;

wherein wireless coordination of locking or unlocking is user-selectable as to how many of the second and third locks wirelessly coordinate locking or unlocking with the first lock; and wherein the first, second, and third locks have first and second modes that are configured by a user, wherein, in a first mode, less than all of the first, second, and third locks are locked or unlocked and, in a second mode, all of the first, second, and third locks are locked or unlocked, and wherein, when either the first, second, or third lock is actuated by the user and based on if the actuated first, second, or third lock is in the first mode or the second mode, the actuated first, second, or third lock transmits the associated first, second, or third signal to trigger the actuation of the other corresponding locks.

8. The lockset of claim 7, wherein the first lock and the second lock are installed on the same door.

9. The lockset of claim 8, wherein the third lock is installed on a different door from the first lock and the second lock.

10. The lockset of claim 7, wherein the first lock is configured to move to the unlocked position responsive to detecting an emergency.

11. The lockset of claim 7, wherein the first lock comprises a deadbolt movable between an extended position and a retracted position.

12. The lockset of claim 11, wherein the second lock comprises a knob configured to move between the locked position and the unlocked position responsive to the wireless communication.

13. The lockset of claim 11, wherein the second lock comprises a mortised bolt mechanism configured to move between the locked position and the unlocked position responsive to the wireless communication.

14. A method of wirelessly coordinating locking and unlocking of an interconnected locking system, the method comprising the steps of:

providing a plurality of locking points positioned around a single secure area opening, each locking point movable between a locked position and an unlocked position, wherein when in the locked position, the plurality of locking points lock the single secure area opening, wherein at least two locking points of the plurality of locking points are arranged in an approximately coplanar manner, and wherein the at least two locking points are configured to wirelessly communicate with at least one other locking point;

actuating at least one of the plurality of locking points between the locked position and the unlocked position;

wherein at least two locking points are configured to:

transmit wireless signals such that (i) a first locking point is configured to transmit a first wireless signal to actuate a second locking point, wherein the second locking point is configured to actuate between a locked and an unlocked position in response to the first wireless signal, and (ii) the second locking point is configured to transmit a second wireless signal to actuate the first locking point, wherein the first locking point is configured to actuate between a locked and an unlocked position in response to the second wireless signal;

wherein coordination of movement between the unlocked position and the locked position is user-selectable as to how many of the plurality of locking points actuate locking or unlocking responsive to the wireless communication; and wherein the at least two locking points have first and second modes that are configured by a user, wherein, in a first mode, less than all of the at least two locking points are locked or unlocked and, in a second mode, all of the at least two locking points are locked or unlocked, wherein, when either the first or second locking point is actuated by the user and based on if the actuated first or second locking point is in the first mode or the second mode, the actuated first or second locking point transmits the associated first or second signal to trigger the actuation of the other corresponding first and second locking point.

15. The method of claim 14, wherein the at least two locking points comprise a deadbolt movable between an extended position and a retracted position.

16. The method of claim 14, wherein at least a portion of the plurality of locking points are of a different type of lock from each other.

17. An interconnected locking system comprising:

a plurality of locking points positioned around a single secure area opening, each locking point movable between a locked position and an unlocked position, wherein when in the locked position, the plurality of locking points lock the single secure area opening, wherein at least two locking points of the plurality of locking points have a wireless communication feature configured to allow wireless communication between the at least two locking points, wherein the plurality of locking points are arranged in an approximately coplanar manner;

wherein the at least two locking points are further configured to:

transmit wireless signals such that (i) a first locking point is configured to transmit a first wireless signal to actuate a second locking point, wherein the second locking point is configured to actuate between a locked and an unlocked position in response to the first wireless signal; and (ii) the second locking point is configured to transmit a second wireless signal to actuate the first locking point, wherein the first locking point is configured to actuate between a locked and an unlocked position in response to the second wireless signal;

wherein wireless coordination of movement between the unlocked position and the locked position is user-selectable as to: (1) which of the plurality of locking points actuate locking or unlocking responsive to a wireless communication signal from at least one of the plurality of locking points; and (2) how many of the plurality of locking points wirelessly coordinate movement; and wherein the at least two locking points have first and second modes that are configured by a user, wherein, in a first mode, less than all of the at least two locking points are locked or unlocked and, in a second mode, all of the at least two locking points are locked or unlocked, wherein, when either the first or second locking point is actuated by the user and based on if the actuated first or second locking point is in the first mode or the second mode, the actuated first or second locking point transmits the associated first or second signal to trigger the actuation of the other corresponding first or second locking point.

18. The system of claim 17, wherein at least a portion of the plurality of locking points move between the locked position and the unlocked position responsive to wireless communications received from another locking point.

19. The system of claim 17, wherein at least one of the plurality of locking points is a deadbolt and wherein at least a portion of the plurality of locking points move between the locked position and the unlocked position responsive to wireless communications indicative of the deadbolt moving between the locked position and the unlocked position.

20. The system of claim 19, wherein at least one of the plurality of locking points is a knob that is configured to move between the locked position and the unlocked position responsive to wireless communications indicative of the deadbolt moving between the locked position and the unlocked position.

21. The system of claim 20, wherein the plurality of locking points includes a plurality of mortised bolt mechanisms configured to move between the locked position and the unlocked position responsive to wireless communications indicative of the deadbolt moving between the locked position and the unlocked position.

22. The system of claim 17, wherein at least a portion of the plurality of locking points enter into the unlocked position responsive to a wireless communication indicative of an emergency.

23. The system of claim 17, wherein at least a portion of the locking points are of a different type of lock from each other.

* * * * *